US009272527B2

(12) United States Patent
Aoyama et al.

(10) Patent No.: US 9,272,527 B2
(45) Date of Patent: Mar. 1, 2016

(54) INK JET METHOD, INK JET APPARATUS, AND INK JET COMPOSITION STORING BODY

(71) Applicant: Seiko Epson Corporation, Tokyo (JP)

(72) Inventors: Tetsuya Aoyama, Shiojiri (JP); Hiroaki Kida, Shiojiri (JP); Keitaro Nakano, Matsumoto (JP); Hitoshi Tsuchiya, Chino (JP); Toshiyuki Yoda, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/661,134

(22) Filed: Mar. 18, 2015

(65) Prior Publication Data

US 2015/0266308 A1 Sep. 24, 2015

(30) Foreign Application Priority Data

Mar. 19, 2014 (JP) ..... 2014-056109

(51) Int. Cl.
*B41J 2/19* (2006.01)

(52) U.S. Cl.
CPC ..... *B41J 2/19* (2013.01)

(58) Field of Classification Search
CPC .... B41J 2/17509; B41J 2/17513; B41J 2/175; B41J 2/17596; B41J 2/17523; B41J 2/17556; B41J 2/17553; B41J 2/2114; B41J 11/0015; B41J 11/002; B41J 2/2056; B41J 2/21; B41J 2/0057; B41J 3/60
USPC ..... 347/84–86
See application file for complete search history.

(56) References Cited

U.S. PATENT DOCUMENTS

| | | | | |
|---|---|---|---|---|
| 2009/0040249 | A1* | 2/2009 | Wouters et al. | 347/7 |
| 2010/0085396 | A1* | 4/2010 | Yokota et al. | 347/7 |
| 2011/0148962 | A1* | 6/2011 | Kaneko | 347/10 |
| 2013/0321520 | A1* | 12/2013 | Ito et al. | 347/100 |

FOREIGN PATENT DOCUMENTS

JP 2013-177525 A 9/2013

* cited by examiner

*Primary Examiner* — Manish S Shah
(74) *Attorney, Agent, or Firm* — Harness, Dickey & Pierce, P.L.C.

(57) ABSTRACT

An ink jet method includes feeding an ultraviolet curing type ink jet composition from a composition storing body which stores an ultraviolet curing type ink jet composition, which contains a polymerizable compound and a hindered amine compound as a polymerization inhibitor, with a storing volume of the composition of 2.5 L to 20 L to an ink jet head through a channel, deaerating the ultraviolet curing type ink jet composition in the channel, and discharging the ultraviolet curing type ink jet composition from the ink jet head, in which an amount of a dissolved gas of the ultraviolet curing type ink jet composition after the deaeration is 30 ppm or less and an amount of a dissolved gas of the ultraviolet curing type ink jet composition stored in the composition storing body is 10 ppm or more.

7 Claims, 2 Drawing Sheets

INK JET METHOD, INK JET APPARATUS, AND INK JET COMPOSITION STORING BODY

BACKGROUND

1. Technical Field

The present invention relates an ink jet method, an ink jet apparatus, and an ink jet composition storing body.

2. Related Art

In the related art, as a method of forming an image on a recording medium such as paper based on an image data signal, various types of systems have been used. Among those, since, in an ink jet system, an ink is discharged onto only a necessary image part to directly form an image on a recording medium using a cheap apparatus, the ink can be effectively used and a running cost is cheap. Furthermore, since the noise of the ink jet system is small, the ink jet system is excellent as a recording method.

In recent year, in order to form an image having high water resistance, solvent resistance, abrasion resistance, or the like on a surface of the recording medium, in the recording method of the ink jet system, an ultraviolet curing type ink composition for ink jet recording which is cured by irradiation with an ultraviolet ray is used.

For example, an ink storing body which includes specific vinyl ether group-containing (meth)acrylic acids and a hindered amine compound and stores the ultraviolet curing type ink composition for ink jet recording in which an amount of dissolved oxygen is 20 ppm is disclosed in JP-A-2013-177525.

However, as to a recording method using the ink storing body described in JP-A-2013-177525, a recording amount in which recording can be continuously performed was small and it was necessary to frequently replace the ink storing body.

SUMMARY

Therefore, an advantage of some aspects of the invention is to provide an ink jet method capable of continuously using for a long time and excellent in preservation stability and discharge stability.

In addition, another advantage of some aspects of the invention is to provide an ink jet apparatus for performing the ink jet method and an ink storing body used in the ink jet method.

In addition, still another advantage of some aspects of the invention is to provide an ink storing body capable of continuously using for a long time and excellent in preservation stability, an ink jet method which is performed by using the ink storing body, and an ink jet apparatus using the ink storing body.

The present inventors conducted intensive studies, and the invention is realized in the following forms.

Therefore, the invention is as follow.

[1] There is provided an ink jet method including feeding an ultraviolet curing type ink jet composition from a composition storing body which stores an ultraviolet curing type ink jet composition, which contains a polymerizable compound and a hindered amine compound, with a storing volume of the composition of 2 L or more to an ink jet head through a channel, deaerating the ultraviolet curing type ink jet composition in the channel, and discharging the ultraviolet curing type ink jet composition from the ink jet head, in which an amount of a dissolved gas of the ultraviolet curing type ink jet composition after the deaeration is 30 ppm or less and an amount of a dissolved gas of the ultraviolet curing type ink jet composition stored in the composition storing body is 10 ppm or more.

[2] In the ink jet method according to [1], in the composition storing body, the ultraviolet curing type ink jet composition fills a container which is configured with a member in which a nitrogen permeability is 0.1 cc·20 μm/($m^2$·day·atm) or more and an oxygen permeability is 1.0 cc·20 μm/($m^2$·day·atm) or more.

[3] In the ink jet method according to [1] or [2], the ultraviolet curing type ink jet composition contains a thioxanthone-based compound as a photopolymerization initiator.

[4] In the ink jet method according to any one of [1] to [3], an amount of a dissolved gas of the ultraviolet curing type ink jet composition stored in the composition storing body is from 10 ppm to 55 ppm.

[5] In the ink jet method according to any one of [1] to [4], a storing volume of the ultraviolet curing type ink jet composition stored in the storing body is from 2.5 L to 20 L.

[6] In the ink jet method according to any one of [1] to [5], an expiration date of the storing body is 15 months or shorter.

[7] In the ink jet method according to any one of [1] to [6], the ultraviolet curing type ink jet composition contains monofunctional (meth)acrylate having a vinyl ether group as a polymerizable compound.

[8] There is provided an ink jet apparatus using an ultraviolet curing type ink jet composition in the ink jet method according to any one of [1] to [7].

[9] There is provided an ink jet composition storing body in which an ultraviolet curing type ink jet composition which contains a polymerizable compound and a hindered amine compound is stored with a storing volume of the composition of 2 L or more and an amount of a dissolved gas of the ultraviolet curing type ink jet composition which is stored is 10 ppm or more.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
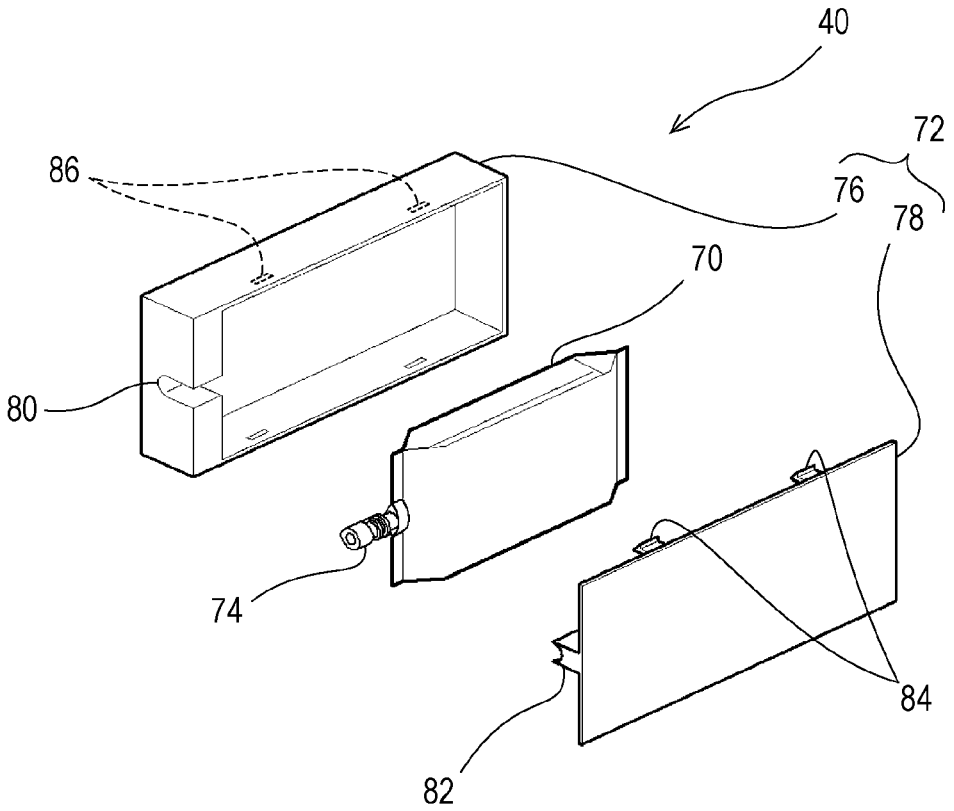
FIG. 1 is an exploded perspective view illustrating an example of an ink storing body of the invention.

Hereinafter, aspects for embodying the invention (hereinafter, referred to as an "embodiment") will be described in detail. Meanwhile, the invention is not limited to the following embodiments and various types of modifications can be carried out within a range of the gist.

In the specification, the term "curing properties" means properties of curing in response to light. The term "preservation stability" means properties in which the viscosity before and after preserving is hardly changed when an ink composition is preserved. The term "discharge stability" means properties of discharging always stable liquid droplets of an ink composition from a nozzle without clogging of a nozzle. The term "continuous usage possibility" means properties in which a composition can be continuously used without replacing a composition storing body.

In the specification, the term "(meth)acrylate" means at least any one of acrylate and methacrylate corresponding thereto, the term "(meth)acryl" means at least any one of acryl and methacryl corresponding thereto, and the term "(meth) acryloyl" means at least any one of acryloyl and methacryloyl corresponding thereto.

Ultraviolet Curing Type Ink Jet Composition

The ultraviolet curing type ink jet composition of the embodiment (hereinafter, also, simply referred to as an "ink jet composition") is a composition which is discharged from the ink jet head by using the ink jet method and then is used. Hereinafter, as an embodiment of an ultraviolet curing type ink jet composition, while an ultraviolet curing type ink jet ink composition (also, simply referred to as an ink composition or an ink) will be described, the composition may be a composition except an ink composition. Hereinafter, an additive agent (component) which is included or may be included in the ink jet composition in the embodiment will be explained.

Hindered Amine Compound

The ink composition of the embodiment includes a hindered amine compound as a polymerization inhibitor. Generally, since it is difficult to obtain an effect of suppressing the polymerization of an ink (dark reaction) by oxygen as the amount of dissolved oxygen in the ultraviolet curing type ink composition is low, there is a tendency in which the preservation stability is decreased. However, by containing a hindered amine-based polymerization inhibitor in the ink composition, even in a case where the amount of dissolved oxygen is low, it is possible to ensure the preservation stability of the ink composition.

The hindered amine compound is not limited to the following, however, for example, a compound having a 2,2,6,6-tetramethylpiperidine-N-oxyl skeleton, a compound having a 2,2,6,6-tetramethylpiperidine skeleton, a compound having a 2,2,6,6-tetramethylpiperidine-N-alkyl skeleton, a compound having a 2,2,6,6-tetramethylpiperidine-N-acyl skeleton, and the like are included.

As a commercial product of the hindered amine compound, ADEKA STAB LA-7RD (2,2,6,6-tetramethyl-4-hydroxypiperidine-1-oxyl) (trade name manufactured by ADEKA CORPORATION), IRGASTAB UV 10 (4,4'-[1,10-dioxo-1,10-decanediyl)bis(oxy)]bis[2,2,6,6-tetramethyl]-1-piperidinyloxy) (CAS. 2516-92-9) and TINUVIN 123 (4-hydroxy-2,2,6,6-tetramethylpiperidine-N-oxyl) (hereinbefore, trade names manufactured by BASF Japan Ltd.), FA-711HM and FA-712HM (2,2,6,6-tetramethylpiperidinyl methacrylate, trade names manufactured by Hitachi Chemical Company, Ltd.), TINUVIN 111FDL, TINUVIN 144, TINUVIN 152, TINUVIN 292, TINUVIN 765, TINUVIN 770DF, TINUVIN 5100, SANOL LS-2626, CHIMASSORB 119FL, CHIMASSORB 2020 FDL, CHIMASSORB 944 FDL, and TINUVIN 622 LD (hereinbefore, trade names manufactured by BASF Japan Ltd.), and LA-52, LA-57, LA-62, LA-63P, LA-68LD, LA-77Y, LA-77G, LA-81, and LA-82, (1,2,2,6,6-pentamethyl-4-piperidyl methacrylate), and LA-87 (hereinbefore, trade names manufactured by ADEKA CORPORATION) are exemplified.

Meanwhile, among the commercial products described above, LA-82 is a compound having a 2,2,6,6-tetramethylpiperidine-N-methyl skeleton and ADEKA STAB LA-7RD and IRGASTAB UV 10 are compounds having a 2,2,6,6-tetramethylpiperidine-N-oxyl skeleton.

Among those described above, since it is possible to make the preservation stability of the ink more excellent while maintaining excellent curing properties, a compound having a 2,2,6,6-tetramethylpiperidine-N-oxyl skeleton is preferable.

A specific example of the compound having a 2,2,6,6-tetramethylpiperidine-N-oxyl skeleton described above is not limited to the following, however, 2,2,6,6-tetramethyl-4-hydroxypiperidine-1-oxyl, 4,4'-[1,10-dioxo-1,10-decanediyl) bis(oxy)]bis[2,2,6,6-tetramethyl]-1-piperidinyloxy, 4-hydroxy-2,2,6,6-tetramethylpiperidine-N-oxyl, bis(1-oxyl-2,2,6,6-tetramethylpiperidine-4-yl) sebacate, and decanedionic acid bis(2,2,6,6-tetramethyl-1-(octyloxy)-4-piperidinyl)ester are exemplified.

The hindered amine compound may be used alone as one kind or may be used in combination of two kinds or more thereof.

The content of the hindered amine compound is preferably from 0.05% by mass to 0.5% by mass and more preferably from 0.1% by mass to 0.5% by mass, with respect to the total mass of the ink composition (100% by mass). When the content thereof is 0.05% by mass or more, it is possible to make the preservation stability of the ink more excellent, and the content thereof is 0.1% by mass or more, it is possible to make the preservation stability of the ink even more excellent. In addition, the content thereof is 0.5% by mass or less, there is a tendency in which the curing properties become more excellent.

Other Polymerization Inhibitors

The ink composition of the embodiment may be further included a compound except the hindered amine compound, as a polymerization inhibitor. Other polymerization inhibitors are not limited to the following, however, for example, p-methoxyphenol, hydroquinone monomethyl ether (MEHQ), hydroquinone, cresol, t-butylcatechol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butylphenol) are included.

The other polymerization inhibitors may be used alone as one kind or may be used in combination of two kinds or more thereof. The content of the other polymerization inhibitors is not particularly limited since the content thereof is determined according to the relationship with the content of the other components.

Photopolymerization Initiator

The ink composition of the embodiment may include a photopolymerization initiator and, in particular, may be include a thioxanthone-based photopolymerization initiator excellent in solubility, safety, and cost performance. The thioxanthone-based photopolymerization initiator is used for curing the ink which exists on the surface of the recording medium by photopolymerization by irradiation with an ultraviolet ray to form a print and it is possible to enhance the curing properties of the ink composition by containing the thioxanthone-based photopolymerization initiator. By using an ultraviolet ray (UV) among radiations, the safety becomes excellent and it is possible to reduce the cost of a light resource lamp.

The thioxanthone-based photopolymerization initiator is not particularly limited, however, specifically, it is preferable to include one kinds or more selected from a group consisting of thioxanthone, diethylthioxanthone, isopropylthioxanthone, and chlorothioxanthone. Meanwhile, there is no limitation, however, 2,4-diethylthioxanthone as diethylthioxanthone, 2-isopropylthioxanthone as isopropylthioxanthone, and 2-chlorothioxanthone as chlorothioxanthone are preferable. As long as the ink composition includes such a thioxanthone-based photopolymerization initiator, there is a tendency in which the curing properties, the preservation stability, and the discharge stability become more excellent. Among those, the thioxanthone-based photopolymerization initiator including diethylthioxanthone is preferable. Since the initiator includes diethylthioxanthone, there is a tendency in which the ultraviolet light (UV light) in a wide region can be more effectively converted to an active species.

A commercial product of the thioxanthone-based photopolymerization initiator is not particularly limited, however, specifically, Speedcure DETX (2,4-diethylthioxanthone) and Speedcure ITX (2-isopropylthioxanthone) (hereinbefore, manufactured by Lambson Limited), KAYACURE DETX-S (2,4-diethylthioxanthone) (manufactured by Nippon Kayaku Co., Ltd), and the like are exemplified.

The content of the thioxanthone-based photopolymerization initiator is preferably from 0.5% by mass to 4% by mass and more preferably from 1% by mass to 4% by mass, with respect to the total mass of the ink composition (100% by mass). When the content thereof is 0.5% by mass or more, there is a tendency in which the curing properties of the ink become more excellent. In addition, the content thereof is 4% by mass or less, there is a tendency in which excellent discharge stability is more effectively maintained. It is assumed that a cause in which the discharge stability from the head remarkably deteriorates in a case where the concentration of dissolved oxygen of the ink composition is high when the thioxanthone-based photopolymerization initiator is used, is that the thioxanthone-based photopolymerization initiator exists as fine particles in the ink composition and those particles become bubble nuclei, and thus the phenomenon in which oxygen dissolved in the ink composition appears as bubbles while preserving in the ink composition is accelerated. However, this is one presumption, and the cause is not limited thereto.

Other Photopolymerization Initiator

The ink composition may further include other photopolymerization initiators. By using an ultraviolet ray (UV) among radiations, the safety becomes excellent and it is possible to reduce the cost of a light resource lamp. As long as other photopolymerization initiators are initiators in which an active species such as a radical or a cation is produced by an energy of light (ultraviolet ray) to initiate the polymerization of the polymerizable compound, there is no limitation, however, a photo-radical polymerization initiator or a photo-cation polymerization initiator can be used, and above all, it is preferable to use a photo-radical polymerization initiator.

The photo-radical polymerization initiator is not particularly limited, however, for example, aromatic ketones, an acylphosphine oxide compound, an aromatic onium salt compound, an organic peroxide, a thio compound (thiophenyl group-containing compound), an α-aminoalkylphenone compound, a hexaarylbiimidazole compound, a ketoxime ester compound, a borate compound, an azinium compound, a metallocene compound, an active ester compound, a compound having a carbon-halogen bond, and an alkylamine compound are included.

Among those, it is preferable to further include an acylphosphine oxide-based photopolymerization initiator (acylphosphine oxide compound). By combining the acylphosphine oxide-based photopolymerization initiator and the thioxanthone-based photopolymerization initiator, there is a tendency in which the ink composition becomes excellent through a curing process by a UV-LED, and thus, the curing properties of the ink composition become even more excellent.

The acylphosphine oxide-based photopolymerization initiator is not particularly limited, however, specifically, bis(2,4,6-trimethylbenzoyl)-phenylphosphine oxide, 2,4,6-trimethylbenzoyl-diphenyl-phosphine oxide, bis-(2,6-dimethoxybenzoyl)-2,4,4-trimethylpentylphosphine oxide, and the like are exemplified.

A commercial product of the acylphosphine oxide-based photopolymerization initiator is not particularly limited, however, for example, IRGACURE 819 (bis(2,4,6-trimethylbenzoyl)-phenylphosphine oxide), DAROCUR TPO (2,4,6-trimethylbenzoyl-diphenyl-phosphine oxide), and the like are included.

The content of the acylphosphine oxide-based photopolymerization initiator is preferably from 3% by mass to 20% by mass, more preferably from 5% by mass to 15% by mass, and even more preferably from 7% by mass to 14% by mass, with respect to the total mass of the ink composition (100% by mass) in a viewpoint that the effect described above is more excellent.

The photo-radical polymerization initiator is not particularly limited, however, for example, acetophenone, acetophenone benzyl ketal, 1-hydroxycyclohexyl phenyl ketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenylpropane-1-one, and 2-methyl-1-[4-(methylthio)phenyl]-2-morpholino-propan-1-one are included.

A commercial product of the photo-radical polymerization initiator is not particularly limited, however, for example, IRGACURE 651 (2,2-dimethoxy-1,2-diphenylethane-1-one), IRGACURE 184 (1-hydroxy-cyclohexyl-phenyl-ketone), DAROCUR 1173 (2-hydroxy-2-methyl-1-phenyl-propan-1-one), IRGACURE 2959 (1-[4-(2-hydroxyethoxy)-phenyl]-2-hydroxy-2-methyl-1-propane-1-one), IRGACURE 127 (2-hydroxy-1-{4-[4-(2-hydroxy-2-methyl-propionyl)-benzyl]phenyl}-2-methyl-propan-1-one}, IRGACURE 907 (2-methyl-1-(4-methyl thiophenyl)-2-morpholinopropane-1-one), IRGACURE 369 (2-benzyl-2-dimethylamino-1-(4-morpholinophenyl)-butanone-1), IRGACURE 379 (2-(dimethylamino)-2-[(4-methylphenyl) methyl]-1-[4-(4-morpholinyl)phenyl]-1-butanone), IRGACURE 784 (bis(15-2,4-cyclopentadiene-1-yl)-bis(2,6-difluoro-3-(1H-pyrrol-1-yl)-phenyl)titanium), IRGACURE OXE 01 (1,2-octanedione, 1-[4-(phenylthio)-, 2-(O-benzoyloxime)]), IRGACURE OXE 02 (ethanone, 1-[9-ethyl-6-(2-methylbenzoyl)-9H-carbazol-3-yl]-, 1-(O-acetyloxime)), IRGACURE 754 (a mixture of oxyphenylacetic acid, 2-[2-oxo-2-phenyl acetoxy ethoxy]ethyl ester and oxyphenylacetic acid, 2-(2-hydroxyethoxyl)ethyl ester) (hereinbefore, manufactured by BASF Japan Ltd.), Speedcure TPO (hereinbefore, manufactured by Lambson Limited), Lucirin TPO, LR8893, and LR8970 (hereinbefore, manufactured by BASF Japan Ltd.), Ubecryl P36 (manufactured by UCB Japan Co. Ltd.), and the like are included.

The cation polymerization initiator is not particularly limited, however, specifically, a sulfonium salt, an iodonium salt, and the like are exemplified.

A commercial product of the cation polymerization initiator is not particularly limited, however, specifically, IRGACURE 250, IRGACURE 270, and the like are exemplified.

The photopolymerization initiator may be used alone as one kind or may be used in combination of two kinds or more thereof.

The content of the photopolymerization initiator is preferably from 5% by mass to 20% by mass with respect to the total mass of the ink composition (100% by mass). When the content thereof is within the range, it is possible to sufficiently exhibit an ultraviolet curing rate and avoid an unmelted residue of the photopolymerization initiator and the coloring derived from the photopolymerization initiator. Amount of dissolved gas of composition stored in storing body As to the composition in the embodiment, it is preferable that the amount of a dissolved gas is 10 ppm or more in a state of being stored in the composition storing body (also, simply referred to as a storing body) in terms of the preservation stability of the ink. In the invention, the amount of a dissolved gas is a total gas amount of dissolve oxygen and dissolve nitrogen. The amount of a dissolved gas can be measured by a method of Example described later.

As to the amount of a dissolved gas of the composition stored in the storing body, the lower limit is preferably 12 ppm or more, more preferably 15 ppm or more, and even more preferably 20 ppm or more, and the upper limit is not limited, however, is preferably 70 ppm or less, more preferably 60 ppm or less, even more preferably 50 ppm or less, and particularly preferably 40 ppm or less. When the amount of a dissolved gas is within the range described above, there is a tendency in which the polymerization of the polymerization compound is further inhibited and the preservation stability becomes more excellent. In addition, the stability of discharge when the ink is discharged from the head becomes more excellent and the deaeration efficiency described later also becomes more excellent. In particular, the ink composition of the embodiment includes the hindered amine compound described above as a polymerization inhibitor and has the amount of dissolved oxygen within a predetermined range, and thus the preservation stability becomes extremely excellent. The amount of a dissolved gas of the composition stored in the storing body may be set to 10 ppm or more, for example, by adjusting the degree of deaeration when preparing the composition.

The amount of a dissolved gas of the composition stored in the storing body may be within the predetermined range described above at least when the storing body starts to be used in the ink jet recording apparatus. Furthermore, it is preferable that the period in which the amount of a dissolved gas is within the predetermined range described above is a period from delivering the ink storing body in which the ink composition is stored until the ink storing body starts to be used in the ink jet recording apparatus. Meanwhile, in a case of a recording apparatus provided with a deaeration mechanism, it is possible to decrease the amount of a dissolved gas in the recording apparatus. However, even in this case, a deaeration capacity may have a limitation and since it is preferable to ensure the deaeration efficiency, the amount of a dissolved gas of the composition in the ink storing body may be within the range described above.

Here, in a case of not conducting the treatment such as deaeration for the purpose of decreasing the amount of a dissolved gas, the amount of a dissolved gas of the ink composition is 70 ppm or more at maximum. Therefore, in a case of reducing the amount of a dissolved gas smaller than the above, the treatment such as deaeration may be conducted. The treatment is not limited to the following, however, for example, a method using a deaeration mechanism, and the like are included.

The dissolved gas in the ultraviolet curing type ink jet composition stored in the storing body is sometimes consumed and decreased while preserving when gas acts as a polymerization inhibitor of the polymerizable compound included in the composition, and on the contrary, in a case where a constituent material of a member of a container in the storing body has gas permeability, the gas is intruded through the member and is increased. Therefore, the amount of a dissolved gas of the composition is sometimes changed while preserving the storing body.

Polymerizable Compound

The ink composition includes the polymerizable compound. The polymerizable compound is polymerized when being irradiated with light by the polymerizable compound alone or by an action of the photopolymerization initiator and can cure the ink composition which is printed. The polymerizable compound is not particularly limited, however, specifically, conventionally well-known monofunctional, bifunctional, and multifunctional, which is tri- or higher functional, monomers and an oligomer can be used. The polymerizable compound may be used alone as one kind or in combination of two kinds or more thereof. Hereinafter, these polymerizable compounds will be exemplified.

The monofunctional, bifunctional, and multifunctional, which is tri- or higher functional, monomers are not particularly limited, however, for example, unsaturated carboxylic acid such as (meth)acrylic acid, itaconic acid, crotonic acid, isocrotonic acid, and maleic acid; a salt of the unsaturated carboxylic acid; an ester, an urethane, an amide, and an anhydride of the unsaturated carboxylic acid; acrylonitrile, styrene, and various types of unsaturated polyesters, unsaturated polyethers, unsaturated polyamides, and unsaturated urethanes are included. In addition, as monofunctional, bifunctional, and multifunctional, which is tri- or higher functional, oligomers, for example, an oligomer such as a linear acrylic oligomer, formed from the monomer described above, epoxy (meth)acrylate, oxetane(meth)acrylate, aliphatic urethane (meth)acrylate, aromatic urethane(meth)acrylate, and polyester(meth)acrylate are included.

In addition, other monofunctional monomers and multifunctional monomers may include N-vinyl compound. The N-vinyl compound is not particularly limited, however, for example, N-vinylformamide, N-vinylcarbazole, N-vinylacetamide, N-vinylpyrrolidone, N-vinylcaprolactam, and acryloylmorpholine, a derivative thereof, and the like are included.

Among polymerizable compounds, an ester of (meth) acrylic acid, that is, (meth)acrylate is preferable.

Monofunctional(meth)acrylate is not particularly limited, however, for example, isoamyl(meth)acrylate, stearyl(meth) acrylate, lauryl(meth)acrylate, octyl(meth)acrylate, decyl (meth)acrylate, isomyristyl(meth)acrylate, isostearyl(meth) acrylate, 2-ethylhexyl-diglycol(meth)acrylate, 2-hydroxybutyl(meth)acrylate, butoxyethyl(meth)acrylate, ethoxy diethylene glycol(meth)acrylate, methoxy diethylene glycol(meth)acrylate, methoxy polyethylene glycol(meth) acrylate, methoxy propylene glycol(meth)acrylate, phenoxyethyl(meth)acrylate, tetrahydrofurfuryl(meth)acrylate, isobornyl(meth)acrylate, 2-hydroxyethyl(meth)acrylate, 2-hydroxypropyl(meth)acrylate, 2-hydroxy-3-phenoxypropyl(meth)acrylate, lactone-modified flexible(meth)acrylate, t-butyl cyclohexyl(meth)acrylate, dicyclopentanyl(meth) acrylate, and dicyclopentenyloxyethyl(meth)acrylate are included. Among those, phenoxyethyl(meth)acrylate is preferable.

The content of monofunctional (meth)acrylate is preferably from 30% by mass to 85% by mass and more preferably from 40% by mass to 75% by mass, with respect to the total mass of the ink composition (100% by mass). By setting to be within the preferable range described above, there is a tendency in which the curing properties, the solubility of initiator, the preservation stability, and the discharge stability become more excellent.

As monofunctional (meth)acrylate, monofunctional (meth)acrylate containing a vinyl ether group is also included. Such monofunctional (meth)acrylate is not particularly limited, however, for example, (meth)acrylic acid 2-vinyloxyethyl, (meth)acrylic acid 3-vinyloxypropyl, (meth) acrylic acid 1-methyl-2-vinyloxyethyl, (meth)acrylic acid 2-vinyloxypropyl, (meth)acrylic acid 4-vinyloxybutyl, (meth)acrylic acid 1-methyl-3-vinyloxypropyl, (meth) acrylic acid 1-vinyloxymethylpropyl, (meth)acrylic acid 2-methyl-3-vinyloxypropyl, (meth)acrylic acid 1,1-dimethyl-2-vinyloxyethyl, (meth)acrylic acid 3-vinyloxybutyl, (meth)acrylic acid 1-methyl-2-vinyloxypropyl, (meth) acrylic acid 2-vinyloxybutyl, (meth)acrylic acid 4-vinyloxy cyclohexyl, (meth)acrylic acid 6-vinyloxyhexyl, (meth) acrylic acid 4-vinyloxy methyl cyclohexylmethyl, (meth) acrylic acid 3-vinyloxy methyl cyclohexylmethyl, (meth) acrylic acid 2-vinyloxy methyl cyclohexylmethyl, (meth) acrylic acid p-vinyloxy methyl phenylmethyl, (meth)acrylic acid m-vinyloxy methyl phenylmethyl, (meth)acrylic acid o-vinyloxy methyl phenylmethyl, (meth)acrylic acid 2-(vinyloxy ethoxy)ethyl, (meth)acrylic acid 2-(vinyloxy isopropoxy)ethyl, (meth)acrylic acid 2-(vinyloxy ethoxy)propyl, (meth)acrylic acid 2-(vinyloxy ethoxy)isopropyl, (meth) acrylic acid 2-(vinyloxy isopropoxy)propyl, (meth)acrylic acid 2-(vinyloxy isopropoxy)isopropyl, (meth)acrylic acid 2-(vinyloxy ethoxy ethoxy)ethyl, (meth)acrylic acid 2-(vinyloxy ethoxy isopropoxy)ethyl, (meth)acrylic acid 2-(vinyloxy isopropoxy ethoxy)ethyl, (meth)acrylic acid 2-(vinyloxy isopropoxy isopropoxy)ethyl, (meth)acrylic acid 2-(vinyloxy ethoxy ethoxy)propyl, (meth)acrylic acid 2-(vinyloxy ethoxy isopropoxy)propyl, (meth)acrylic acid 2-(vinyloxy isopropoxy ethoxy)propyl, (meth)acrylic acid 2-(vinyloxy isopropoxy isopropoxy)propyl, (meth)acrylic acid 2-(vinyloxy ethoxy ethoxy)isopropyl, (meth)acrylic acid 2-(vinyloxy ethoxy isopropoxy)isopropyl, (meth)acrylic acid 2-(vinyloxy isopropoxy ethoxy)isopropyl, (meth)acrylic acid 2-(vinyloxy isopropoxy isopropoxy)isopropyl, (meth)acrylic acid 2-(vinyloxy ethoxy ethoxy ethoxy)ethyl, (meth)acrylate 2-(vinyloxy ethoxy ethoxy ethoxy ethoxy)ethyl, (meth) acrylic acid 2-(isopropenoxy ethoxy)ethyl, (meth)acrylic acid 2-(isopropenoxy ethoxy ethoxy)ethyl, (meth)acrylic acid 2-(isopropenoxy ethoxy ethoxy ethoxy)ethyl, (meth) acrylic acid 2-(isopropenoxy ethoxy ethoxy ethoxy ethoxy) ethyl, (meth)acrylic acid polyethylene glycol monovinyl ether, (meth)acrylic acid polypropylene glycol monovinyl ether, phenoxyethyl(meth)acrylate, isobornyl(meth)acrylate, and benzyl(meth)acrylate are included. Among those, (meth) acrylic acid 2-(vinyloxy ethoxy)ethyl, phenoxyethyl(meth) acrylate, isobornyl(meth)acrylate, and benzyl(meth)acrylate are preferable.

Among those, since it is possible to further decrease the viscosity of the ink, a flash point is high, and the curing properties of the ink are excellent, (meth)acrylic acid 2-(vinyloxy ethoxy)ethyl, that is, at least any one of acrylic acid 2-(vinyloxy ethoxy)ethyl and methacrylic acid 2-(vinyloxy ethoxy)ethyl is preferable and acrylic acid 2-(vinyloxy ethoxy)ethyl is more preferable. Since both of acrylic acid 2-(vinyloxy ethoxy)ethyl and methacrylic acid 2-(vinyloxy ethoxy)ethyl have simple structures and have low molecular weights, it is possible to remarkably decrease the viscosity of ink. As (meth)acrylic acid 2-(vinyloxy ethoxy)ethyl, (meth) acrylic acid 2-(2-vinyloxy ethoxy)ethyl and (meth)acrylic acid 2-(1-vinyloxy ethoxy)ethyl are exemplified and as acrylic acid 2-(vinyloxy ethoxy)ethyl, acrylic acid 2-(2-vinyloxy ethoxy)ethyl and acrylic acid 2-(1-vinyloxy ethoxy) ethyl are exemplified. Meanwhile, acrylic acid 2-(vinyloxy ethoxy)ethyl is more excellent in terms of the curing properties, compared to methacrylic acid 2-(vinyloxy ethoxy)ethyl.

Among the vinyl ether group-containing monofunctional (meth)acrylates described above, the vinyl ether group-containing (meth)acrylic acid esters represented by the following general formula (I) are preferable in terms of the above.

$$CH_2{=}CR^1{-}COOR^2{-}O{-}CH{=}CH{-}R^3 \quad (I)$$

(In the formula, $R^1$ is a hydrogen atom or a methyl group, $R^2$ is a divalent organic residue having 2 to 20 carbon atoms, and $R^3$ is a hydrogen atom or a monovalent organic residue having 1 to 11 carbon atoms.)

By containing the vinyl ether group-containing monofunctional (meth)acrylic acid esters in the ink composition, it is possible to make the curing properties of the ink excellent, furthermore, it is also possible to decrease the viscosity of the ink. Moreover, it is preferable to use a compound having both a vinyl ether group and a (meth)acrylic group in one molecule rather than to separately use a compound having a vinyl ether group and a compound having a (meth)acrylic group, for making the curing properties of the ink excellent.

In the general formula (I) described above, as a divalent organic residue having 2 to 20 carbon atoms represented by $R^2$, a linear, branched, or cyclic alkylene group having 2 to 20 carbon atoms which may be substituted, an alkylene group having 2 to 20 carbon atoms which has an oxygen atom by an ether bond and/or an ester bond in a structure and may be substituted, and a divalent aromatic group having 6 to 11 carbon atoms which may be substituted are suitable. Among those, an alkylene group having 2 to 6 carbon atoms such as an ethylene group, an n-propylene group, an isopropylene group, and a butylene group and an alkylene group having 2 to 9 carbon atoms such as an oxyethylene group, an oxy n-propylene group, an oxyisopropylene group, and an oxybutylene group, which has an oxygen atom by an ether bond in a structure, are suitably used.

In the general formula (I) described above, as a monovalent organic residue having 1 to 11 carbon atoms represented by $R^3$, a linear, branched, or cyclic alkyl group having 1 to 10 carbon atoms which may be substituted and an aromatic group having 6 to 11 carbon atoms which may be substituted are suitable. Among those, an alkyl group having 1 to 2 carbon atoms which is a methyl group or an ethyl group and an aromatic group having 6 to 8 carbon atoms such as a phenyl group and a benzyl group are suitably used.

In a case where each organic residue described above is a group which may be substituted, the substituents are divided into a group which includes carbon atoms and a group which does not include carbon atoms. Firstly, in a case where the substituent is a group which includes carbon atoms, the carbon atoms are counted as the number of carbons of the organic residue. The group which includes carbon atoms is not limited to the following, however, for example, a carboxyl group and an alkoxy group are included. Next, the group which does not include carbon atoms is not limited to the following, however, for example, a hydroxyl group and a halo group are included.

The content of the vinyl ether group-containing monofunctional (meth)acrylic acid esters, and in particular, the polymerizable compound represented by the general formula (1), and above all, the content of (meth)acrylic acid 2-(vinyloxy ethoxy)ethyl is preferably from 10% by mass to 70% by mass and more preferably from 30% by mass to 50% by mass, with respect to the total mass of the ink composition (100% by mass). When the content is 10% by mass or more, it is possible to decrease the viscosity of the ink and it is possible to make the curing properties of the ink more excellent. On the other hand, when the content is 70% by mass or less, it is possible to maintain the preservation stability of the ink in an excellent state.

Among (meth)acrylate described above, as bifunctional (meth)acrylate, for example, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonane diol di(meth)acrylate, neopentyl glycol di(meth)acrylate, dimethylol-tricyclodecane di(meth)acrylate, di(meth)acrylate of an EO (ethylene oxide) adduct of bisphenol A, di(meth)acrylate of an PO (propylene oxide) adduct of bisphenol A, hydroxypivalic acid neopentyl glycol di(meth)acrylate, polytetramethylene glycol di(meth)acrylate, diethylene glycol di(meth)acrylate, triethylene glycol di(meth)acrylate, and tri- or higher functional (meth)acrylate having a pentaerythritol skeleton or a dipentaerythritol skeleton are included. Among those, dipropylene glycol di(meth)acrylate is preferable. Above all, dipropylene glycol di(meth)acrylate, tripropylene glycol di(meth)acrylate, diethylene glycol di(meth)acrylate, triethylene glycol di(meth)acrylate, and tri- or higher functional (meth)acrylate having a pentaerythritol skeleton or a dipentaerythritol skeleton are preferable. It is more preferable that multifunctional (meth)acrylate is added to monofunctional (meth)acrylate to be included in the ink composition.

The content of multifunctional (meth)acrylate which is bi- or higher functional is preferably from 5% by mass to 60% by mass, more preferably from 15% by mass to 60% by mass, and even more preferably from 20% by mass to 50% by mass, with respect to the total mass of the ink composition (100% by mass). When the content thereof is set to be within the preferable range, there is a tendency in which the curing properties, the preservation stability, the discharge stability become more excellent.

Among (meth)acrylate described above, as multifunctional (meth)acrylate which is tri- or higher functional, for example, trimethylolpropane tri(meth)acrylate, EO-modified trimethylolpropane tri(meth)acrylate, pentaerythritol tri (meth)acrylate, pentaerythritol tetra(meth)acrylate, dipentaerythritol hexa(meth)acrylate, ditrimethylolpropane tetra (meth)acrylate, glycerin propoxy tri(meth)acrylate, caprolactone-modified trimethylolpropane tri(meth)acrylate, pentaerythritol ethoxy tetra(meth)acrylate, and caprolactam-modified dipentaerythritol hexa(meth)acrylate are included.

Among those, it is preferable that the polymerizable compound include monofunctional (meth)acrylate. In this case, the viscosity of the ink composition becomes low, the solubility of the photopolymerization initiator and other additive agents is excellent, and the discharge stability is easily obtained during ink jet recording. Furthermore, since toughness, heat resistance, and chemical resistance of the coated film are increased, it is more preferable that monofunctional (meth)acrylate is used with bifunctional (meth)acrylate and above all, it is even more preferable that phenoxyethyl(meth) acrylate is used with dipropylene glycol di(meth)acrylate.

The content of the polymerizable compound described above is preferably from 5% by mass to 95% by mass and more preferably from 15% by mass to 90% by mass, with respect to the total mass of the ink composition (100% by mass). When the content of the polymerizable compound is within the range described above, it is possible to further reduce the viscosity and odor as well as it is possible to make the solubility and the reactivity of the photopolymerization initiator further excellent.

Color Material

The ink composition may further include a color material. As a color material, at least one of a pigment and a dye can be used.

Pigment

By using a pigment as a color material, it is possible to enhance light resistance of the ink composition. As a pigment, both of an inorganic pigment and an organic pigment can be used.

As an inorganic pigment, carbon blacks (C.I. Pigment Black 7) such as furnace black, lamp black, acetylene black, or channel black, iron oxide, or titanium oxide can be used.

As an organic pigment, an azo pigment such as an insoluble azo pigment, a condensed azo pigment, azo lake, or a chelate azo pigment, a polycyclic pigment such as a phthalocyanine pigment, a perylene and perinone pigment, an anthraquinone pigment, a quinacridone pigment, a dioxane pigment, a thioindigo pigment, an isoindolinone pigment, or a quinophthalone pigment, a dye chelate (for example, basic dye type chelate, acid dye type chelate, or the like), dye lake (basic dye type lake or acid dye type lake), a nitro pigment, a nitroso pigment, aniline black, and a daylight fluorescent pigment are exemplified.

More specifically, as carbon black used for a black ink, No. 2300, No. 900, MCF88, No. 33, No. 40, No. 45, No. 52, MA7, MA8, MA100, No. 2200B, or the like (hereinbefore, manufactured by Mitsubishi Chemical Corporation), Raven 5750, Raven 5250, Raven 5000, Raven 3500, Raven 1255, Raven 700, or the like (hereinbefore, manufactured by Carbon Columbia), Regal 400R, Regal 330R, Regal 660R, Mogul L. Monarch 700, Monarch 800, Monarch 880, Monarch 900, Monarch 1000, Monarch 1100, Monarch 1300, Monarch 1400, or the like (manufactured by CABOT JAPAN K.K.), and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 (hereinbefore, manufactured by Degussa) are exemplified.

As a pigment using for white ink, C.I. Pigment White 6, 18, and 21 are exemplified.

As a pigment using for yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180 are exemplified.

As a pigment using for magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, and 245 and C.I. Pigment Violet 19, 23, 32, 33, 36, 38, 43, and 50 are exemplified.

As a pigment using for cyan ink, C.I. Pigment Blue 1, 2, 3, 15, 15:1, 15:2, 15:3, 15:34, 15:4, 16, 18, 22, 25, 60, 65, and 66 and C.I. Vat Blue 4 and 60 are exemplified.

In addition, as a pigment except magenta, cyan, and yellow, for example, C.I. Pigment Green 7 and 10, C.I. Pigment Brown 3, 5, 25, and 26, and C.I. Pigment Orange 1, 2, 5, 7, 13, 14, 15, 16, 24, 34, 36, 38, 40, 43, and 63 are exemplified.

The pigment described above may be used alone as one kind or may be used together with two kinds or more thereof.

In a case of using the pigment described above, the average particle diameter thereof is preferably 300 nm or less and more preferably from 50 nm to 200 nm. When the average particle diameter is within the range described above, the reliability such as the discharge stability or the dispersion stability in the ink composition is more excellent and it is possible to form an image having excellent image quality. Here, the average particle diameter in the specification is measured by a dynamic light-scattering method.

Dye

As a coloring material, a dye can be used. The dye is not particularly limited, and an acid dye, a direct dye, a reactive dye, and a basic dye can be used. As the dye described above, for example, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C.I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35 are exemplified.

The dye described above may be used alone as one kind or may be used together with two kinds or more thereof.

The content of the coloring material is preferably from 1% by mass to 20% by mass with respect to the total mass of the ink composition (100% by mass) since it is possible to obtain excellent concealing properties and color reproducibility. The ink composition may be set to a clear composition (clear ink) which does not include the coloring material or contains the coloring material to an extent not intended for coloring (for example, 0.1% by mass or less).

Dispersant

In a case where the ink composition includes the pigment, the ink composition may further include a dispersant in order to make the pigment dispersibility more excellent. The dispersant is not particularly limited, however, for example, a dispersant such as a polymer dispersant which is commonly used to prepare a pigment dispersion liquid is included. As a specific example thereof, a dispersant which contains one kind or more among polyoxyalkylene polyalkylene polyamine, a vinyl-based polymer and copolymer, an acrylic-based polymer and copolymer, polyester, polyamide, polyimide, polyurethane, an amino-based polymer, a silicon-containing polymer, a sulfur-containing polymer, a fluorine-containing polymer, and an epoxy resin, as a main component, is included. As a commercial product of the polymer dispersant, AJISUPER series manufactured by Ajinomoto Fine-Techno Co., Inc., Solsperse series (Solsperse 36000 or the like) available from Avecia Corp. or Noveon Inc., Disperbyk series manufactured by BYK Chemie, and DISPARLON series manufactured by Kusumoto Chemicals, Ltd. are exemplified.

Other Additive Agent

The ink composition may include an additive agent (component) except the additive agents described above. Such a component is not particularly limited, however, for example, a conventionally well-known slip agent (surfactant), polymerization accelerator, penetration promoting agent, wetting agent (moisturizing agent), and other additive agents can be used. As other additive agents described above, for example, a conventionally well-known fixing agent, antifungal agent, antiseptic agent, antioxidant, ultraviolet absorbing agent, chelating agent, pH adjusting agent, and thickener are included.

Composition Storing Body

The composition storing body of the embodiment is a composition storing body in which the ultraviolet curing type ink jet composition is stored. Hereinafter, while there is a case of describing as an ink storing body as an embodiment of a composition storing body, not only the ink storing body but also the composition storing body may be applied. An aspect of the composition storing body of the embodiment is not limited to the following, however, for example, an ink cartridge, a pack, a bottle, a tank, a bin, and a can are included. Among those, an ink cartridge, a pack, a bottle, and a tank are preferable and a pack is more preferable, and a pack made of a film is particularly preferable since they are commonly used and the degree of the oxygen permeability described later is easily controlled to a predetermined value. Among parts with which the storing body is provided, a part which comes into contact with the composition and in which the composition directly fills is particularly called a container. For example, in a case of the composition storing body which is an ink cartridge, an ink pack provided inside of the ink cartridge is a container. The container may be set to a storing body that the container is a storing body. An example thereof is a bottle or the like.

As an aspect of usage of the ink storing body of the embodiment, at least (A) a form of the ink cartridge or the like which is separate from the recording apparatus, is installed in the recording apparatus, and sequentially supplies the ink to the recording apparatus, (B) a form which is separate from the recording apparatus and in which only the ink is transferred from the ink storing body such as the bottle to the recording apparatus when the ink is used, and (C) a form of the tank or the like which is provided in the recording apparatus in advance and in which the ink is stored, are exemplified.

It can be said that (A) and (B) described above are the ink storing bodies from delivering the ink storing body up to immediately before supplying (transferring) the ink to the recording apparatus. It can be said that (C) described above is the ink storing body from delivering the recording apparatus up to before starting to use the ink in the recording apparatus for the first time.

Meanwhile, it can be said that (A) and (C) described above are the ink storing bodies which perform printing of the recording apparatus in a state where the ink is supplied from an ink container to the recording apparatus through a connecting part such as an ink tube.

In addition, it can be said that (B) described above is the ink storing body in which printing is performed in the recording apparatus after transferring the ink from the ink storing body to the recording apparatus. Meanwhile, as an object for transferring the ink in (B), the tank and the like provided in the recording apparatus are exemplified.

In addition, a constituent material of the container is not limited to the following, however, for example, a plastic such as polyethylene terephthalate (PET) and polypropylene (PP), various kinds of metals (including an alloy), and polyolefin such as polyethylene, ethylene-vinyl acetate copolymer, and polypropylene are included. In addition, the constituent material is not limited to the above and may be a polymer, a film thereof, or the like obtained by blending or laminating each polymer described above at proper ratio.

The gas permeability (hereinafter, also referred to as a "degree of gas permeability") of the constituent material of the member configuring the container is preferably 0.1 cc·20 μm/($m^2$·day·atm) or more as a nitrogen permeability. The upper limit of the nitrogen permeability is not limited, however, is preferably 15,000 cc·20 μm/($m^2$·day·atm) or less, more preferably 5,000 cc·20 μm/($m^2$·day·atm) or less, even more preferably 20 cc·20 μm/($m^2$·day·atm) or less, and particularly preferably 5 cc·20 μm/($m^2$·day·atm) or less. In addition, the gas permeability is preferably 1.0 cc·20 μm/($m^2$·day·atm) or more as an oxygen permeability. The upper limit of the oxygen permeability is not limited, however, is preferably 5,000 cc·20 μm/($m^2$·day·atm) or less, more preferably 1,000 cc·20 μm/($m^2$·day·atm) or less, even more preferably 100 cc·20 μm/($m^2$·day·atm) or less, particularly preferably 20 cc·20 μm/($m^2$·day·atm) or less, and more particularly preferably 10 cc·20 μm/($m^2$·day·atm) or less. When the degree of gas permeability is within the range described above, the gas is easily intruded to the ink composition of the storing body while preserving, and thus, it is possible to make the preservation stability of the composition more excellent. In addition, the gas intrusion is appropriately suppressed, and thus, it is possible to make the discharge stability more excellent.

The constituent material or the member is not particularly limited. In a case of the ink pack, the film can be used by thermally fusing (heat seal) the film to process into a bag shape. As a film used in an ink pack, a stretched plastic film such as polyethylene, polypropylene, ethylene-vinyl alcohol copolymer, and polystyrene having high density, low density, or linear low density is exemplified. Above all, ethylene-vinyl alcohol copolymer (EVOH), polyethylene terephthalate (PET), polypropylene (PP), polyethylene (PE) are preferable in a viewpoint that the gas permeability is easily set to be within the preferable range and the durability of the film is also excellent.

The film may be a laminated film in which the films having a plurality of layers are bonded to each other. In a case where the degree of gas permeability described above is obtained from the film described above, the film may be configured from only the film, or the degree of oxygen permeability or the degree of nitrogen permeability may be ensured by laminating a gas barrier layer on the film. As a gas barrier layer, a metal layer such as an aluminum layer or an inorganic oxide layer such as a silicon oxide layer or an aluminum oxide layer may be used, and among the films described above, an ethylene-vinyl alcohol copolymer, polyvinyl alcohol, or the like in which the degree of gas permeability is low, may be laminated. The total film thickness of the film is preferably 50 μm or more, more preferably 70 μm or more, and even more preferably from 70 μm to 200 μm. When the film has the film thickness described above, the amount of a dissolved gas of the ink composition is hardly changed while preserving and it is possible to obtain the strength and the flexibility of the pack. Among those, the film consisting of an ethylene-vinyl alcohol copolymer is preferable in a viewpoint that the degree of gas permeability is low and the strength is excellent. In addition, in a case of the storing body except the pack, other synthetic resins, glasses, metals, and the like are exemplified in addition to the above.

Meanwhile, as to the degree of gas permeability in the embodiment, a unit is set to cc·20 μm/($m^2$·day·atm) and the "atm" is set to a pressure (atm) under conditions of 20° C. and drying gas (relative humidity 0%). In addition, the degree of oxygen permeability can be calculated by a method defined in ISO 14663-2: 1999 (Annex C), that is, by measuring a permeation speed (when the relative humidity reaches an equilibrium state) of oxygen which is penetrated through the film using a coulometric analysis sensor.

The volume (storing volume) of the ink composition stored in the ink storing body in the embodiment is 2 L or more. In a case where the storing volume is 2 L or more, while it is possible to ensure the continuous usage possibility of the storing body, it became clear that the trend in which the amount of a dissolved gas of the composition was increased while preserving the storing body was large. It is assumed that this is because a surface area of the storing body is large. According to the embodiment, it is possible to ensure excellent discharge stability while ensuring the continuous usage possibility of the storing body with the storing volume of 2 L or more.

The lower limit of the storing volume is preferably 2.5 L or more and more preferably 3 L or more, and the upper limit thereof is not limited, however, is preferably 20 L or less and more preferably 10 L or less. When the capacity thereof is within the range described above, the continuous usage possibility of the storing body becomes more excellent and it is possible to make the discharge stability more excellent.

In the embodiment, the continuous usage possibility of the storing body is a performance which is determined according to the amount of work performed using the composition from starting to use the composition stored in the storing body up to using up all composition, such as recording in the ink jet apparatus without replenishing the composition except the composition stored in the storing body and replacing the storing body.

In the embodiment, an expiration date of the storing body is preferably 20 months or shorter, and more preferably 15 months or shorter. The expiration date of the storing body is set to a time which is up to a period in which the storing body can be used after the storing body is manufactured and delivered and a time specified by a manufacturer and seller of the storing body. The lower limit of the expiration date is not limited, however, is preferably 5 months or longer and more preferably 10 months or longer. When the expiration date is within the range described above, it is more preferable in terms of the preservation stability, the discharge stability, and deaeration efficiency, furthermore, the expiration of the expiration date of the storing body can be reduced.

Here, the ink cartridge which is an example of the ink storing body of the embodiment will be described. FIG. 1*s* an exploded perspective view illustrating an ink cartridge 40. The ink cartridge 40 consists of an ink pack 70 which is a container filled with the ink and a cartridge case 72 consisting of a main body case 76 which houses the ink pack 70 inside so as to protect and a lid part 78, the ink pack 70 is provided with a ink supply port 74, and the main body case 76 is provided with a hook part 84, a notch part 80, and a pressing part 82. As the constituent material of the ink pack 70, the constituent material described above can be used.

Ink Jet Apparatus

The ink jet apparatus of the embodiment is provided with a feeding unit that feeds an ultraviolet curing type ink jet composition from the composition storing body to the ink jet head (head) through the channel, deaerating unit that deaerates the amount of a dissolved gas of the ultraviolet curing type ink jet composition to 30 ppm or less in the channel between the composition storing body and the ink jet head, and a discharging unit that discharges the ultraviolet curing type ink jet composition from the ink jet head. In the embodiment, an embodiment of the ink jet apparatus is also referred to as an ink jet recording apparatus or an ink jet printer, however, the ink jet apparatus may be an ink jet apparatus except a recording apparatus or a printer. The ink jet apparatus can be provided with a curing unit which cures the composition which is discharged by irradiation with an ultraviolet ray in addition to the discharging unit.

Discharging Unit and Feeding Unit

Figure 2:
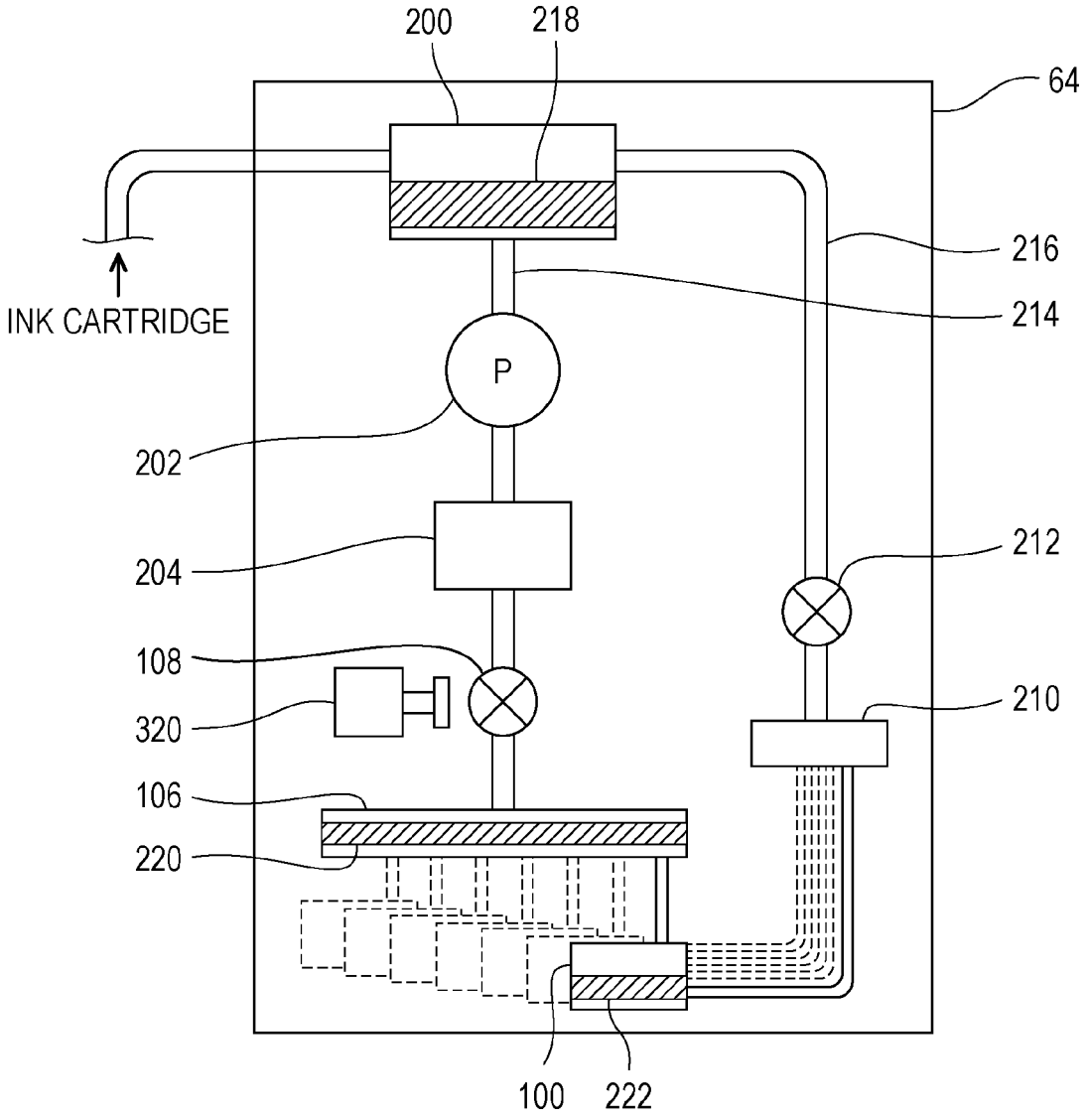
FIG. 2 is a view illustrating an example of a feeding unit and a discharging unit in an ink jet apparatus of the invention.

The ink jet apparatus discharges the ultraviolet curing type ink composition for ink jet recording from the head. Hereinafter, specifically, description will be given using drawings, however, the discharging unit is not limited to the following. FIG. 2 is a schematic view illustrating an example of the periphery of a head of an ink jet recording apparatus in an embodiment. A sub tank 200 is supplied with the ink from the ink cartridge (not shown), makes the ink pass through a deaeration module 204 which is an example of a deaeration mechanism and a heater 220 in order by a pressurizing pump 202, and supply the ink to the heads 100 which are plurally arranged.

The head 100 which is a specific example of the discharging unit discharges the ink to the recording medium (not shown). A pressure adjusting valve 108 is opened by a valve opening actuator 320 to adjust the pressure of ink when the ink is supplied from the sub tank 200 to the head 100.

The ink which is passed through the deaeration module 204 flows into a branched joint 106 when the pressure adjusting valve 108 is opened. An outward route 214 is branched into a plurality of paths inside the branched joint 106 and connected to a plurality of heads 100.

The ink which is not discharged from the head 100 is circulated to the sub tank 200 through an integrated joint 210 and a return route 216 in a state where an opening and closing valve 212 is opened. By circulating the ink between the sub tank 200 and the head 100, in a case where the ink is retained for a long time and the ink component is separated and precipitated, it is possible to recover ink or make the temperature of the ink which is circulated constant. The viscosity of the ink is decreased by being heated by the heaters 218, 220, and 222 and becomes a viscosity suitable for discharging from the head 100 to discharge the ink from the head 100.

These apparatuses are arranged on a main scanning moving table 64 and main scanning in which the discharge of the ink is performed from the head 100 to the recording medium while each main scanning moving table 64 moves with respect to the recording medium, is performed.

The feeding unit is an apparatus that feeds the composition from the composition storing body to the discharging unit. The route in which the composition is fed between the composition storing body and the discharging unit is called a channel. As a channel, in FIG. 2, a channel of the ink from the ink cartridge up to the sub tank 200, a channel from the sub tank 200 up to the head 100, a channel until the ink is discharged from a nozzle of the head inside the head 100, and a circulation route in which the ink is returned from the head 100 up to the sub tank 200 and the ink can be fed from the sub tank 200 to the head 100 again are exemplified.

Deaerating Unit

The ink jet apparatus of the embodiment is provided with the deaerating unit (also referred to as a deaeration mechanism). Hereinafter, as an embodiment of the deaerating unit, the deaeration module will be described. A deaeration chamber (not shown) into which the ink flows and a decompression chamber (not shown) which contacts with the deaeration chamber through a separation film which pass a gas such as air and does not pass a liquid such as an ink are arranged in the deaeration module 204 in FIG. 2. As a separation film, a hollow fiber film or the like can be used. When the decompression chamber is decompressed by a decompression pump (not shown), since gas such as bubbles mixed in the ink in the deaeration chamber or a gas dissolved in the ink gets out, bubbles are not mixed and it is possible to supply the ink, in which the concentration of a dissolved gas is set to be lower than that of the ink which is transferred to the deaeration module 204, to the head 100 and discharge from the head 100. The deaeration module 204 of the recording apparatus can be continuously performed the deaeration of the ink in a state where the ink is continuously supplied from the sub tank 200 to the head 100. It is preferable that the deaeration unit is arranged between the ink channels of the ink storing body and the head in terms of the deaeration efficiency.

The recording apparatus described above can be configured in the way of, for example, FIG. 4 in JP-A-2011-240565 (FIG. 2 in the specification). Meanwhile, the recording apparatus may have a configuration such as a line printer in which the ink is discharged from the head toward the recording medium while the recording medium moves with respect to the head without moving of the apparatus, and in this case, since the used amount of the ink is large, the embodiment is particularly useful. In addition, the deaeration module may have a form of alternately and intermittently performing an act of performing the deaeration of the ink by setting a state where the pressure adjusting valve 108 is closed and decompressing the decompression chamber without being provided with the separation film and an act of setting a state where the pressure of the decompression chamber is returned back to normal pressure and the pressure adjusting valve 108 is opened after the deaeration is finished and supplying the ink to the head, instead of the deaeration module which continuously performs the deaeration of the ink as described above. The former is preferable in a viewpoint that it is possible to continuously deaerate the ink and the latter is preferable in a viewpoint that the deaeration capacity is high.

In the embodiment, the deaeration of the composition is performed by the deaeration unit to decrease the amount of a dissolved gas, and thus the amount of a dissolved gas becomes lower than that of the composition before the deaeration. When the amount of a dissolved gas of the composition which is deaerated by the deaeration unit is 30 ppm or less, it is possible to make the discharge stability excellent. The upper limit of the amount of a dissolved gas of the composition which is deaerated is preferably 20 ppm or less and more preferably 10 ppm or less, and the lower limit thereof is not limited, however, is preferably 1 ppm or more and more preferably 5 ppm or more. When the amount of a dissolved gas of the composition which is deaerated is within the range described above, the discharge stability is more excellent and the deaeration efficiency is also more excellent. In the embodiment, the deaeration efficiency can be indicated, for example, by a deaeration time required for performing the deaeration and as the deaeration time is shorter, the deaeration efficiency is excellent. In order to the set the amount of a dissolved gas of the composition which is deaerated to be within the range described above, for example, the degree of the deaeration of the composition by the deaeration unit may be adjusted and, for example, in a case of the deaeration module described above, the degree of the deaeration of the decompression chamber of the deaeration module may be adjusted or the flow velocity of the composition which flows in the deaeration module may be adjusted.

In a case where the amount of a dissolved gas of the composition stored in the storing body is within the range described above and the amount of a dissolved gas of the composition which is deaerated by the deaeration unit is within the range described above, it is more preferable in terms of being excellent in all of the preservation stability, the discharge stability, and the deaeration efficiency of the composition.

Discharge Object

By using the ink jet method, the composition is used by discharging the ink composition to a discharge object, or the like. While the recording medium will be described as an embodiment of the discharge object, the discharge object is not limited to the recording medium. As a recording medium, for example, an absorptive or non-absorptive recording medium is included. The following ink jet recording method can be widely applied to the recording medium having various absorbing performances from the non-absorptive recording medium into which a water-soluble ink composition is hardly permeated to the absorptive recording medium into which the ink composition is easily permeated. However, in a case where the ink composition is applied to the non-absorptive recording medium, there are some cases where it is required that a drying process is arranged after curing by irradiation with an ultraviolet ray, or the like.

The absorptive recording medium is not particularly limited, however, for example, includes from plain paper or ink jet paper (exclusive paper for ink jet provided with an ink absorbing layer configured from silica particles or alumina particles or an ink absorbing layer configured from a hydrophilic polymer such as polyvinyl alcohol (PVA) or polyvinyl pyrrolidone (PVP)) such as electrophotographic paper in which the permeability of the ink is high, to art paper, coat paper, cast paper, and the like in which the permeability of the ink is relatively low and which are used for a general off-set printing.

The non-absorptive recording medium is not particularly limited, however, for example, includes a film or a plate of plastics such as polyvinyl chloride, polyethylene, polypropylene, or polyethylene terephthalate (PET), a plate of metals such as iron, silver, copper, or aluminum or a metal plate which is manufactured by depositing various types of these metals, a film made of a plastic, a plate of an alloy of stainless steel or brass, and the like.

Ink Jet Method

The ink jet method using the ultraviolet curing type ink jet composition stored in the storing body of the embodiment includes a discharging process of discharging the composition to the discharge object by the ink jet method and can further include a curing process of curing the composition by irradiating the composition which is discharged by the discharging process with an ultraviolet ray. In doing so, a cured product is formed by the composition cured on the discharge object. The ink jet method includes an ink jet recording method, an ink jet molding method, and the like and may be a method in which the composition is discharged by the ink jet method. Hereinafter, as an embodiment of the ink jet method, the ink jet recording method will be described.

Discharging Process

In the discharging process, the ink jet recording apparatus described later can be used. When the ink composition is discharged, it is preferable that the viscosity of the ink composition is set to be preferably 25 mPa·s and less and more preferably from 5 mPa·s to 20 mPa·s. When the viscosity of the ink composition is the above viscosity when setting the temperature of the ink composition to room temperature or setting to a state where the ink composition is not heated, it is possible to discharge the ink composition when setting the temperature of the ink composition to room temperature or without heating the ink composition. On the other hand, the viscosity is set to a preferable viscosity by heating the ink composition to a predetermined temperature and the ink composition may be discharged. In doing so, excellent discharge stability is realized.

Since the viscosity of the ultraviolet curing type ink composition is higher than that of an aqueous ink composition used in a usual ink for ink jet, the viscosity variation is large due to the temperature variation when discharging. The viscosity variation of the ink strongly affects with respect to a change in size of a liquid droplet or a change in discharge speed of a liquid droplet and, eventually the image quality deterioration may occur. Therefore, it is preferable to keep the temperature of the ink during discharging constant as much as possible.

Curing Process

Next, in the curing process, the ink composition which is discharged on the recording medium is cured by irradiation with an ultraviolet ray (light). In other words, a coated film of the ink formed on the recording medium becomes a cured film by irradiation with an ultraviolet ray. This is because that the photopolymerization initiator which can be included in the ink composition is decomposed by irradiation with an ultraviolet ray to generate an initiator species such as a radical, an acid, and a basic and the polymerization reaction of the photopolymerization compound is accelerated by a function of the initiator species. Alternatively, this is because that the photopolymerization reaction of the polymerizable compound starts by irradiation with an ultraviolet ray. At this time, when a sensitizing dye exists with the photopolymerization initiator in the ink composition, the sensitizing dye is rendered into an excited state by absorbing an active radiation in a system, the decomposition of photopolymerization initiator is accelerated by coming into contact with the photopolymerization initiator, and it is possible to achieve a higher degree of curing reaction.

As an ultraviolet ray source, a mercury lamp, a gas or a solid laser, or the like is mainly used and as a light source used for curing the ultraviolet curing type ink composition for ink jet recording, a mercury lamp and a metal halide lamp are widely known. On the other hand, currently, mercury-free is strongly desired from the viewpoint of environmental preservation, a replacement with a GaN-based semiconductor ultraviolet ray light emitting device is industrially and environmentally very useful. Furthermore, an ultraviolet light emitting diode (UV-LED) and an ultraviolet laser diode (UV-LD) are small, have long lives and high efficiency, and are low cost and is expected as a light source for ultraviolet ray curing type ink jet. Among those, a UV-LED is preferable.

Here, it is preferable to use such an ink composition as can be cured by irradiation with an ultraviolet ray in which a light emitting peak wavelength is preferably in a range from 365 nm to 405 nm and more preferably from 380 nm to 400 nm. In addition, an irradiation energy is preferably from 50 mJ/cm$^2$ to 1,000 mJ/cm$^2$, more preferably from 100 mJ/cm$^2$ to 700 mJ/cm$^2$, and even more preferably from 200 mJ/cm$^2$ to 600 mJ/cm$^2$.

In the case described above, it is possible to cure with a low energy at high speed due to the composition of the ink composition. The irradiation energy is calculated by multiplying an irradiation time by an irradiation strength. It is possible to shorten the irradiation time depending on the composition of the ink composition and in this case, the printing speed is increased. On the other hand, it is also possible to decrease the irradiation strength depending on the composition of the ink composition in the embodiment and in this case, the miniaturization of the apparatus or a decrease in cost is realized. It is preferable to use a UV-LED for the irradiation with an ultraviolet ray in that case. Such an ink composition is obtain by including the photopolymerization initiator which is decomposed by irradiation with an ultraviolet ray in the wavelength range described above and the polymerization compound which initiates the polymerization by irradiation with an ultraviolet ray in the wavelength range described above. Meanwhile, as to the light emitting peak wavelength, there may be one or may be plural in the wavelength range described above. Even in a case where there are plural light emitting peak wavelengths, the entire irradiation energy of an ultraviolet ray having the light emitting peak wavelength is set to the irradiation energy described above.

The ink jet method of the embodiment is further provided with feeding (feeding process) of the composition which is performed by the feeding unit described above and deaerating (deaeration process) of the composition which is performed by the deaeration unit described above.

Example

Hereinafter, more specifically, the embodiments of the invention will be described using Examples, however, the invention is not limited to only these Examples.

Used Material

Row materials used in the following Examples and Comparative Examples are as follow.

Polymerizable Compound

VEEA (Acrylic acid 2-(2-vinyloxyethoxyl)ethyl, trade name manufactured by NIPPON SHOKUBAI CO., LTD., in the following Table, abbreviated as "VEEA")

SR508 (Dipropylene glycol diacrylate, trade name manufactured by Sartomer Company, in the following Table, abbreviated as "DPGDA") Hindered amine compound (polymerization inhibitor)

ADEKA STAB LA-7RD (2,2,6,6-tetramethyl-4-hydroxypiperidine-1-oxyl, trade name manufactured by ADEKA CORPORATION, in the following Table, abbreviated as "LA-7RD")

Photopolymerization Initiator

DAROCURE TPO (trade name manufactured by BASF JAPAN LTD., solid content 100%)

Speedcure DETX (trade name manufactured by Lambson Limited, solid content 100%)

Measurement of Amount of Dissolved Gas

The measurement of the amount of dissolved oxygen of the ink composition is to respectively measure the amount of dissolved oxygen and the amount of dissolved nitrogen to sum up, using gas chromatography Agilent 6890 (manufactured by Agilent Technologies, Inc.). Helium (He) gas was used as a carrier gas. The numerical value is volume-based ppm.

TABLE 1

| | Composition No. | | | |
|---|---|---|---|---|
| | 1 | 2 | 3 | 4 |
| VEEA | 30.0 | 30.0 | 30.0 | 10.0 |
| DPGDA | 57.9 | 58.0 | 59.4 | 77.9 |
| TPO | 10.0 | 10.0 | 10.0 | 10.0 |
| DETX | 2.0 | 2.0 | 0.5 | 2.0 |
| LA-7RD | 0.1 | | 0.1 | 0.1 |
| Total amount | 100.0 | 100.0 | 100.0 | 100.0 |

TABLE 2

| | | | Method Example | | | | | | | | | | | | | | |
|---|---|---|---|---|---|---|---|---|---|---|---|---|---|---|---|---|---|
| | | | 1 | 2 | 3 | 4 | 5 | 6 | 7 | 8 | 9 | 10 | 18 | 19 | 20 | 21 | 22 |
| Composition No. | | | 1 | 1 | 1 | 1 | 1 | 1 | 1 | 1 | 1 | 1 | 2 | 3 | 4 | 1 | 1 |
| Capacity of storing body (L) | | | 0.1 | 0.1 | 0.1 | 0.1 | 0.1 | 5 | 5 | 5 | 5 | 5 | 5 | 5 | 5 | 3 | 5 |
| Storing body | | | 1 | 1 | 3 | 4 | 2 | 1 | 1 | 3 | 4 | 2 | 2 | 2 | 1 | 2 | 1 |
| After preparation | Amount of dissolved gas (ppm) | | 10 | 20 | 20 | 20 | 20 | 10 | 20 | 20 | 20 | 20 | 20 | 20 | 20 | 20 | 5 |
| After RT1W | Preservation stability | | A | A | A | A | A | A | A | A | A | A | A | A | A | A | A |
| | Curing properties | When discharging (without performing deaeration | A | A | A | A | A | A | A | A | A | A | A | B | B | A | A |
| | Discharge stability | | A | A | A | A | A | A | A | A | A | A | A | A | A | A | A |
| After RT3M | Preservation stability | | C | B | A | A | A | C | B | A | A | A | D | A | A | A | D |
| | Amount of dissolved gas (ppm) | When discharging (without performing deaeration | 10 | 20 | 40 | 40 | 30 | 10 | 20 | 60 | 60 | 40 | 40 | 40 | 20 | 36 | 5 |
| | Curing properties | | A | A | B | B | A | A | A | C | C | B | B | C | B | B | B |
| | Discharge stability | | A | A | C | C | A | A | A | C | C | C | C | B | A | C | A |
| | Amount of dissolved gas (ppm) | When discharging (performing deaeration | 10 | 20 | 20 | 20 | 20 | 10 | 20 | 30 | 30 | 20 | 20 | 20 | 20 | 20 | 5 |
| | Curing properties | | A | A | A | A | A | A | A | A | A | A | B | B | B | A | B |
| | Discharge stability | | A | A | A | A | A | A | A | A | A | A | B | A | A | A | A |
| | Deaeration efficiency | | A | A | A | A | A | A | A | C | C | A | A | A | A | A | A |
| Continuous usage possibility | | | C | C | C | C | C | A | A | A | A | A | A | A | A | A | A |

Method Example

Production of the Ultraviolet Curing Type Ink Composition for Ink Jet Recording

The components described in Table 1 were added so as to be the composition (the unit is % by mass) described in Table 1 and the ultraviolet curing type ink composition for ink jet recording which was a clear ink was prepared by stirring the mixture by using a high speed water-cooled stirring machine. After preparation, the deaeration was performed with respect to the ink composition. At that time, the deaeration time was adjusted for each method example so as to be the amount of a dissolved gas after preparation in Table to use for each method example, using the fact in which as the time of the deaeration is longer, the amount of a dissolved gas becomes low.

TABLE 3

| | | | Method Example | | | | | | |
|---|---|---|---|---|---|---|---|---|---|
| | | | 11 | 12 | 13 | 14 | 15 | 16 | 17 |
| Composition No. | | | 1 | | | | | | |
| Capacity of storing body (L) | | | 5 | | | | | | |
| Quality of material of storing body | | | Storing body 2 | | | | | | |
| After preparation | Amount of dissolved gas (ppm) | | 10 | 20 | 30 | 40 | 50 | 60 | 70 |
| | Curing properties | When discharging | A | A | A | B | B | C | C |
| | Discharge stability | (without performing deaeration | A | A | A | C | C | C | C |

TABLE 3-continued

| | | Method Example | | | | | | |
|---|---|---|---|---|---|---|---|---|
| | | 11 | 12 | 13 | 14 | 15 | 16 | 17 |
| Amount of dissolved gas (ppm) | When discharging (performing deaeration) | 10 | 20 | 20 | 20 | 30 | 30 | 30 |
| Curing properties | | A | A | A | A | A | A | A |
| Discharge stability | | A | A | A | A | A | A | A |
| Deaeration efficiency | | A | A | A | A | B | C | C |
| Continuous usage possibility | | A | A | A | A | A | A | A |

TABLE 4

| Gas permeability (20 μm · cc/m$^2$ · day · atm) | | | | | |
|---|---|---|---|---|---|
| | Storing body No. | | | | |
| | 1 | 2 | 3 | 4 | 5 |
| Note | Aluminum | EVOH | PET | PP | PE |
| $O_2$ | 0 | 1.5 | 54 | 730 | 3,100 |
| $N_2$ | 0 | 0.13 | 8 | 3,400 | 12,000 |

Evaluation Item

As to the ink jet method, the preservation stability, furthermore, the amount of a dissolved gas (when discharging), the discharge stability, the curing properties, the deaeration efficiency, and the continuous usage possibility were evaluated under conditions of each Example in Tables 2 and 3 by the following methods to describe in Tables 2 and 3.

1. Preservation Stability

As a storing body which was used in Examples in Tables 2 and 3, the ink cartridge as shown in FIG. 1 described above was prepared. The ink cartridge which was configured by filling the ink composition which was prepared under conditions of each Example in Table 2 into the ink pack to seal, was left indoor at 25° C. and was kept for 7 days after RT1W and 3 months after RT3M. Then, the thickening rate before and after keeping was determined. As the capacity of the ink pack, the ink pack having a value of each Example in Table was prepared and the capacity of the ink which was filled in the pack was set so as to be a value of each Example in Table. The film which was the member of the ink pack was configured as follow, the periphery of the film was thermally welded to set the container, and after filling the ink, a filling port was sealed.

Storing body 2: was set to the film made of ethylene-vinyl alcohol copolymer (the film thickness of the film was 100 μm)

Storing body 3: was set to the film made of polyethylene terephthalate (the film thickness of the film was 100 μm)

Storing body 4: was set to the film made of polypropylene (the film thickness of the film was 100 μm)

Storing body 5: was set to the film made of polyethylene (the film thickness of the film was 100 μm)

Reference

Storing body 1: was set to the film in which an aluminum vapor deposition layer was arranged with a film thickness of 13 μm on the film of the storing body 2.

When the gas permeability of the film of each storing body was measured, the gas permeability became the values in Table 4. Meanwhile, the film in which the film thickness of the film was set to 20 μm for the gas permeability measurement, was used. The evaluation criteria of the preservation stability are as follow.

A: 4% or less

B: over 4% and 7% or less

C: over 7% and 9% or less

D: over 9%

Meanwhile, in each Example in Table 2, when the amount of a dissolved gas of the ink in the ink pack after RT1W was measured in the same way as the measurement of the amount of a dissolved gas described above, the amount of a dissolved gas after RT1W was almost the same as the amount of a dissolved gas after preparing in Table 2, therefore, as to the ink jet method which was performed using the ink pack after RT1W, it is assumed that the evaluation thereof is almost the same as that of a case where the ink jet method was performed using the ink pack after preparing.

Discharge Test

The ink jet apparatus provided with the feeding unit, the deaerating unit, and the discharging unit as FIG. 2 was prepared. However, the ink jet apparatus was configured as a line printer in which the main scanning moving table 64 was fixed, the recording medium conveying mechanism (not shown) was arranged, and the ink was discharged with respect to the recording medium while conveying the recording medium to the main scanning moving table 64. As to the head 100 of the discharging unit, the discharge nozzle diameter is set to 20 μm, the driving frequency of discharging is set to 20 kHz, the discharge amount of the ink is adjusted to 7 ng per once, and 360 nozzles are provided per one head. Such an ink jet evaluation machine (trail machine) was prepared. The storing body is a storing body which is preserved under conditions of RT1W or RT3M of the evaluation of the preservation stability in Examples in Table 2 and is a storing body after preparing in Examples in Table 3.

The ink storing body (ink cartridge) was connected to the route of the ink up to the sub tank 200 for each Example to supply the ink from the ink storing body to the sub tank. The ink was fed from the ink cartridge to the sub tank so that the amount of the ink in the sub tank always became a predetermined amount or more. When the ink of the ink cartridge was finished, the ink cartridge was replaced to the ink cartridge which was prepared under the same conditions for each evaluation condition of each Example to continue to supply the ink to the sub tank. Each ink feeding unit was operated to feed the ink to the head 100. The deaeration module decompresses and deaerates the ink through the hollow film and made possible the deaeration of the ink while feeding the ink. The ink was fed to the head 100 while deaerating to become possible to discharge the ink from the nozzle of the head 100. Among the heads 100, one head was used for the evaluation and the other heads were set so that the ink was not fed. The temperature of the ink was controlled so that the viscosity of the ink became the viscosity suitable for discharging (10 mPa·s or less) by operating the heater. Then, the discharge of the ink was performed for 30 minutes using the evaluation machine. Here, as to both of a case where the deaeration was performed by operating the deaeration module (in Table, described as performing deaeration) and a case where the deaeration was not performed by stopping the operation of the deaeration module (in Table, described as without performing deaeration), the evaluation was performed. In a case where the deaeration module was operated, the deaeration module was adjusted so as to be the value of the amount of a dissolved gas of the ink of the amount of a dissolved gas (when discharging) measured below and was operated.

2. Amount of Dissolved Gas (when Discharging)

The ink was sampled from the ink channel between the deaeration module 204 and the head 100 at the point of finishing the discharge test described above to measure the amount of a dissolved gas of the ink which was fed to the head. The measurement method is a method of measuring the amount of a dissolved gas described above. The results are described in Table.

3. Discharge Stability

At the point of finishing the discharge test, the nozzle inspection was performed and the number of the nozzles in which undischrage occurred was determined. The evaluation criteria are as follow.

A: Non (0)

B: 1 to 4

C: 5 or more

4. Curing Properties

At around the end of discharging in the discharge test, the discharge was performed onto a PET film (PET50A NPL (trade name), manufactured by Lintec Corporation) and the ink coated film such that the thickness of the coated film after curing became 8 μm was applied. The coated film was cured by irradiation with an ultraviolet ray in which the irradiation intensity was 700 mW/cm$^2$ and the wavelength was 395 nm. The coated film which was cured (cured film) was rubbed 12 times with a weight load of 110 g using a cotton bud and the curing energy (irradiation energy) was determined at the point of not becoming damaged.

Meanwhile, the irradiation intensity (mW/cm$^2$) was measured on an irradiated surface which was irradiated from the light source and the irradiation energy (mJ/cm$^2$) was determined from the product of the value obtained above and the irradiation duration (s). The measurement of the irradiation intensity was performed using an ultraviolet intensity meter UM-10 and a receiving part UM-400 (both are manufactured by KONICA MINOLTA SENSING, INC.).

The evaluation criteria are as follow.

A: 200 mJ/cm$^2$ or less

B: over 200 mJ/cm$^2$ and 300 mJ/cm$^2$ or less

C: over 300 mJ/cm$^2$

5. Deaeration Efficiency

The deaeration efficiency when the discharge test was performed by operating the deaeration module described above was evaluated based on the following criteria.

A: During discharging for 30 minutes, it was possible to deaerate to the amount of a dissolved gas of the amount of a dissolved gas (when discharging) of each Example without interrupting the discharge.

B: During discharging for 30 minutes, it was required once that the circulation in which the discharge was interrupted and the ink was returned from the head to the sub tank through the circulation route, was performed, in order to be the amount of a dissolved gas of the amount of a dissolved gas (when discharging) of each Example.

C: During discharging for 30 minutes, it was required twice or more that the circulation in which the discharge was interrupted and the ink was returned from the head to the sub tank through the circulation route, was performed, in order to be the amount of a dissolved gas of the amount of a dissolved gas (when discharging) of each Example.

6. Continuous Usage Possibility

The discharge was performed under conditions of the discharge test described above and 5 cm×5 cm of a solid pattern was recorded on the recording medium of an A4 size. When recording was performed on 500 sheets of the recording mediums, the evaluation was conducted whether it was necessary to perform replacing of the ink cartridge or not.

A: It was possible to record without replacing the ink cartridge.

C: It was necessary to replace the ink cartridge.

According to the above-results, it was found that the ink jet method in which the composition fed from the composition storing body which stored the ultraviolet curing type ink jet composition which contained the polymerizable compound and the hindered amine compound and in which the amount of a dissolved gas was set to 10 ppm or more, with the storing volume of 2 L or more, was deaerated to the amount of a dissolved gas of 30 ppm or less and was discharged from the ink jet head was more excellent in all of continuous usage possibility, preservation stability, and discharge stability, compared to other ink jet methods.

Furthermore, while not described in Table, after the ink storing body after adjusting in Method Example 10 was preserved at RT for 20 months, when the discharge stability was evaluated under a condition in which the deaeration is performed when discharging, the result was A.

The entire disclosure of Japanese Patent Application No. 2014-056109, filed Mar. 19, 2014 is expressly incorporated by reference herein.

What is claimed is:

1. An ink jet method comprising:

feeding an ultraviolet curing type ink jet composition from a composition storing body which stores an ultraviolet curing type ink jet composition, which contains a polymerizable compound and a hindered amine compound as a polymerization inhibitor;

deaerating the ultraviolet curing type ink jet composition in the channel; and discharging the ultraviolet curing type ink jet composition from the ink jet head, wherein an amount of a dissolved gas of the ultraviolet curing type ink jet composition after the deaeration is 30 ppm or less, wherein an amount of a dissolved gas of the ultraviolet curing type ink jet composition stored in the composition storing body is 10 ppm or more, and wherein a storing volume of the ultraviolet curing type ink jet composition stored in the storing body is from 2.5 L to 20 L.

2. The ink jet method according to claim 1, wherein, in the composition storing body, the ultraviolet curing type ink jet composition fills a container which is configured with a member in which a nitrogen permeability is 0.1 cc·20 μm/(m$^2$·day·atm) or more and an oxygen permeability is 1.0 cc·20 μm/(m$^2$·day·atm) or more.

3. The ink jet method according to claim 1, wherein the ultraviolet curing type ink jet composition contains a thioxanthone-based compound as a photopolymerization initiator.

4. The ink jet method according to claim 1, wherein an amount of a dissolved gas of the ultraviolet curing type ink jet composition stored in the composition storing body is from 10 ppm to 55 ppm.

5. The ink jet method according to claim 1, wherein an expiration date of the storing body is 15 months or shorter.

6. The ink jet method according to claim 1, wherein the ultraviolet curing type ink jet composition contains monofunctional (meth)acrylate having a vinyl ether group as a polymerizable compound.

7. The ink jet method according to claim 1, wherein the step of deaerating the ultraviolet curing type ink jet composition in the channel uses a deaeration module, the deaeration module being positioned in the channel between the storing body and the ink jet head and including a pump and an actuatable valve.

* * * * *